United States Patent [19]

Gow

[11] 4,149,530

[45] Apr. 17, 1979

[54] ELECTRIC MASSAGER

[76] Inventor: Quinn W. Gow, 3941 Towland Cir., Los Alamitos, Calif. 90720

[21] Appl. No.: 804,354

[22] Filed: Jun. 7, 1977

[51] Int. Cl.[2] ..... A61H 1/00

[52] U.S. Cl. ..... 128/36

[58] Field of Search ..... 128/34–36, 128/55, 32

[56] References Cited

U.S. PATENT DOCUMENTS

| | | | |
|---|---|---|---|
| 859,674 | 7/1907 | Lindstrom | 128/36 |
| 2,187,077 | 1/1940 | Erickson | 128/36 UX |
| 3,183,538 | 5/1965 | Hubner | 128/36 X |
| 3,672,355 | 6/1972 | Ogawa et al. | 128/36 |

FOREIGN PATENT DOCUMENTS

| | | | |
|---|---|---|---|
| 263912 | 9/1913 | Fed. Rep. of Germany | 128/34 |
| 394384 | 4/1924 | Fed. Rep. of Germany | 128/36 |
| 220031 | 2/1972 | Fed. Rep. of Germany | 128/36 |
| 11062 | 11/1907 | United Kingdom | 128/36 |

*Primary Examiner*—Lawrence W. Trapp
*Attorney, Agent, or Firm*—Berman, Aisenberg & Platt

[57] ABSTRACT

A hand held, portable, rechargeable electric vibrator which includes a handle portion and a spherical vibrating portion. The handle portion houses a rechargeable battery controlled by an on-off switch. The spherical vibrating portion is substantially hollow and houses an electric motor completely therewithin. The motor includes a shaft having a pair of eccentric weights mounted on respective ends thereof. The spherical vibrating portion is connected to the handle portion by a flat, resilient spring member, and a rubber sheath encloses the spring as well a the electrical wires which connect the battery with the motor. Upon actuation, the eccentrics revolve about the motor so as to impart a vibratory motion to the spherical portion of the device. Embodiments are also disclosed which contain more than one vibrating portion.

12 Claims, 7 Drawing Figures

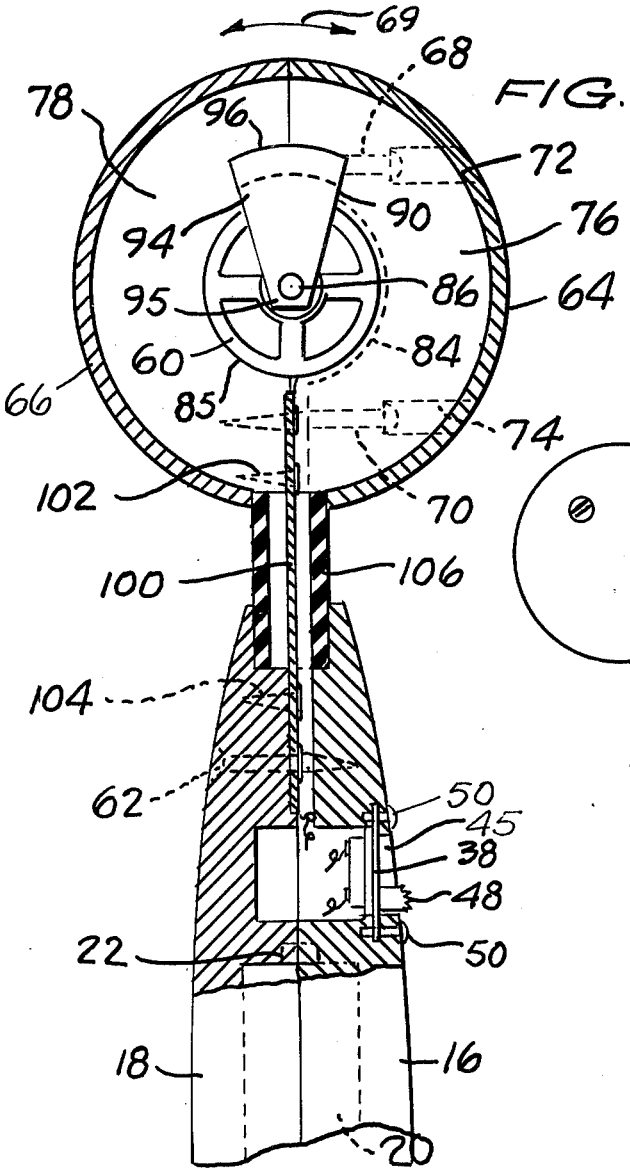
FIG. 4.
FIG. 5.
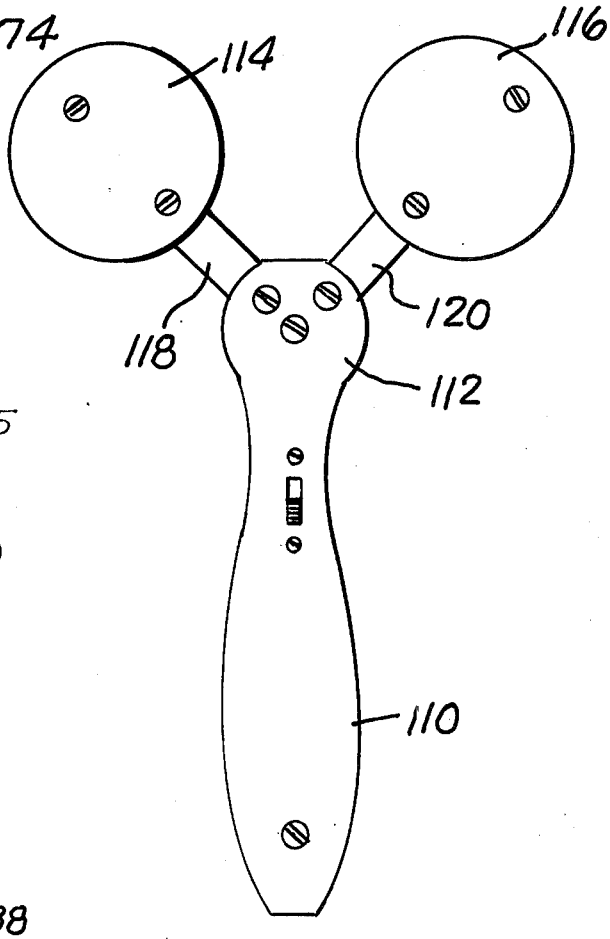
FIG. 7.
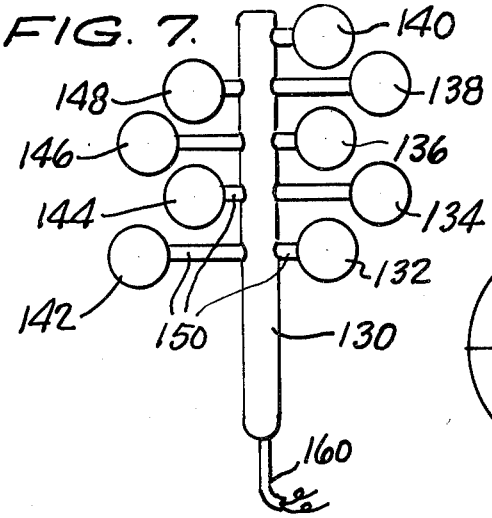
FIG. 6.
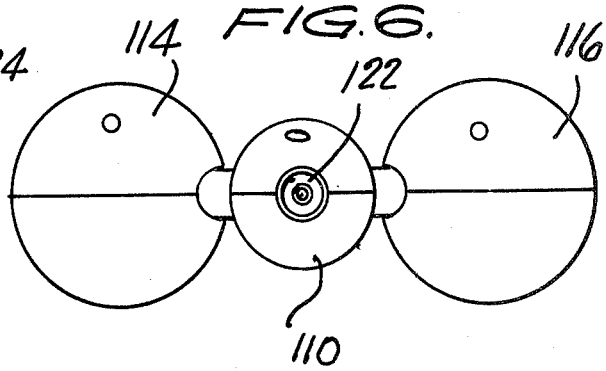

ELECTRIC MASSAGER

BACKGROUND OF THE INVENTION

1. Field of the Invention

The present invention is related to electrical massaging devices and, more particularly, is directed towards a portable, hand held electric massager which includes a self-contained vibrating element.

2. Description of the Prior Art

Many electric massaging devices have been suggested by the prior art. Most such devices, however, suffer from one or more deficiencies. For example, electrically driven massaging devices require an electric outlet for power and thus are not readily portable. Further, such devices which operate on wall current require transformers which tends to make the devices bulky, weighty and otherwise cumbersome to use.

Most electric vibrators or massagers operate on the principle whereby a weight is eccentrically mounted on the shaft of an electric motor. Actuation of the motor rotates the shaft, and the portion of the massaging device containing the weight is caused to vibrate. For example, U.S. Pat. No. 3,468,304 discloses an electric massager which includes a handle portion that contains a motor which rotates a shaft having a weight connected thereto. The weight is mounted within a housing which is connected to the handle by a coiled spring.

Such a structure typifies the prior art devices' difficulty in providing an efficient vibratory action as a result of the lengthy shaft that extends between the motor casing and the eccentric weight. The overall design, moreover, does not emphasize vibrations in any particular plane, but gives rise to random oscillations which tend to be less effective and efficient than might otherwise be provided.

Other U.S. patents of which I am aware include: U.S. Pat. Nos. 3,451,391; 3,364,922; 1,723,268; 942,299; 907,377; 850,938; and 667,357.

OBJECTS AND SUMMARY OF THE INVENTION

It is therefore a primary object of the present invention to provide an electric massager which overcomes all of the deficiencies noted above with respect to prior art devices.

Another object of the present invention is to provide a massaging device which is hand held, portable, and may be operated via a rechargeable, self-contained battery.

An additional object of the present invention is to provide an electric massager which is more efficient in operation than prior art designs in that it imparts a greater vibratory action than heretofore possible.

A still further object of the present invention is to provide an efficient electric massaging device which may be constructed of readily available components, is inexpensive to manufacture, and is efficient and easy to operate while providing a greater and therefore more beneficial massaging action.

A more general object of the present invention is to provide a massaging device whose principle of construction may be extended to an entire class of massagers that may employ a multi-headed vibrating action.

The foregoing and other objects are obtained in accordance with one aspect of the present invention through the provision of a massager, which comprises a handle portion, a vibrating portion, resilient means interconnecting the handle portion and the vibrating portion, and electric motor means mounted within the vibrating portion. The vibrating portion more particularly comprises a substantially hollow housing having means for mounting the electric motor therewithin. The electric motor more particularly includes an axial shaft which extends beyond the housing of the motor, and further comprises eccentric weight means mounted to the portion of the shaft that extends beyond the motor housing.

In accordance with more specific aspects of the present invention, the housing of the motor is substantially cylindrical and the motor shaft includes two end portions which extend beyond the ends of the cylindrical motor housing. Even more specifically, the eccentric weight means comprise at least one weight which is mounted to one end portion of the shaft. Preferably, the weight comprises a flat, triangular shaped base whose apex is connected to the end portion of the shaft and an arcuate body portion which is disposed adjacent the cylindrical outer surface of the motor housing and which is connected to the base so as to rotate therewith about the motor. A second weight, substantially identical to the first weight, is also preferably provided and is connected to the other end portion of the motor shaft.

In accordance with yet other aspects of the present invention, the hollow housing is substantially spherical and includes a ring-shaped annulus centrally positioned therein in which the electric motor may be mounted. The handle portion of the apparatus is preferably elongated and includes means for selectively supplying electrical power to the motor within the vibrating portion. The resilient mounting means which connects the vibrating portion with the handle portion preferably comprises a substantially flat, elongated spring, the plane of which is positioned parallel to the axis of the motor shaft in order that vibrations are imparted to the vibrating portion in a single direction. The latter feature maximizes the efficiency of the massaging device to the benefit of the user. Preferably, the flat spring as well as the electrical wiring is encased by a rubber sheath.

The electrical power supply means preferably comprises a rechargeable battery positioned within the handle portion which includes a female connector for selectively receiving a battery recharging apparatus.

In alternative embodiments, more than one vibrating portion may be connected to the handle portion by means of a separate resilient spring. Each of the additional vibrating portions includes its own self-contained electric motor and eccentric weight for maximum efficiency.

BRIEF DESCRIPTION OF THE DRAWINGS

Various objects, features and attendant advantages of the present invention will be more fully appreciated as the same become better understood from the following detailed description of the present invention when considered in connection with the accompanying drawings, in which:

FIG. 4 is a sectional view of the preferred embodiment illustrated in FIG. 3 and taken along line 4—4 thereof;

FIG. 5 is a plan view of an alternative embodiment of the present invention;

FIG. 6 is a bottom view illustrating the alternative embodiment shown in FIG. 5; and FIG. 7 is a plan view of yet another alternative embodiment of the present invention.

DETAILED DESCRIPTION OF THE PREFERRED EMBODIMENTS

Figure 1:
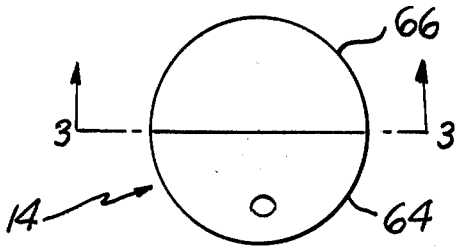
FIG. 1 is a top view of a preferred embodiment of the present invention.
Figure 2:
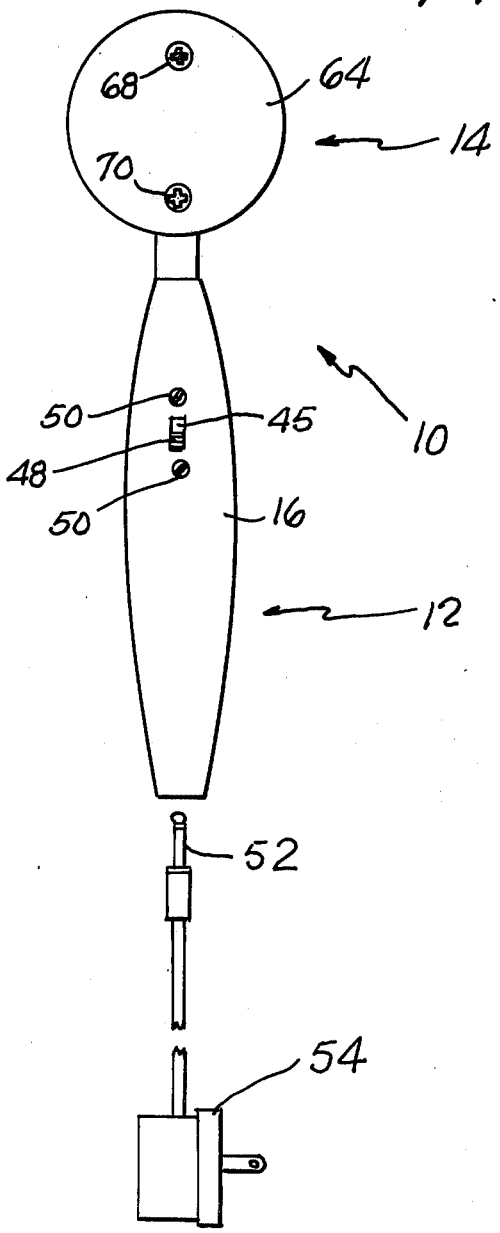
FIG. 2 is a side, plan view of the preferred embodiment of the present invention illustrated in FIG. 1.

Referring now to the drawings, wherein like reference numerals indicate identical or corresponding parts throughout the several views, and more particularly to FIGS. 1 and 2, the electric massager of the present invention is indicated generally by reference numeral 10.

The massager 10 includes a handle portion 12 and a vibrating portion 14. The handle portion 12 includes a pair of elongated handle covers 16 and 18 which are recessed on the inner portions thereof, as evident from FIGS. 3 and 4, so as to house a source of electrical power, such as battery 20, therein. Battery 20 preferably comprises a rechargeable battery, such as a nickel-cadmium battery, which may, for example, provide a DC operating voltage of 2.4 volts.

Figure 3:
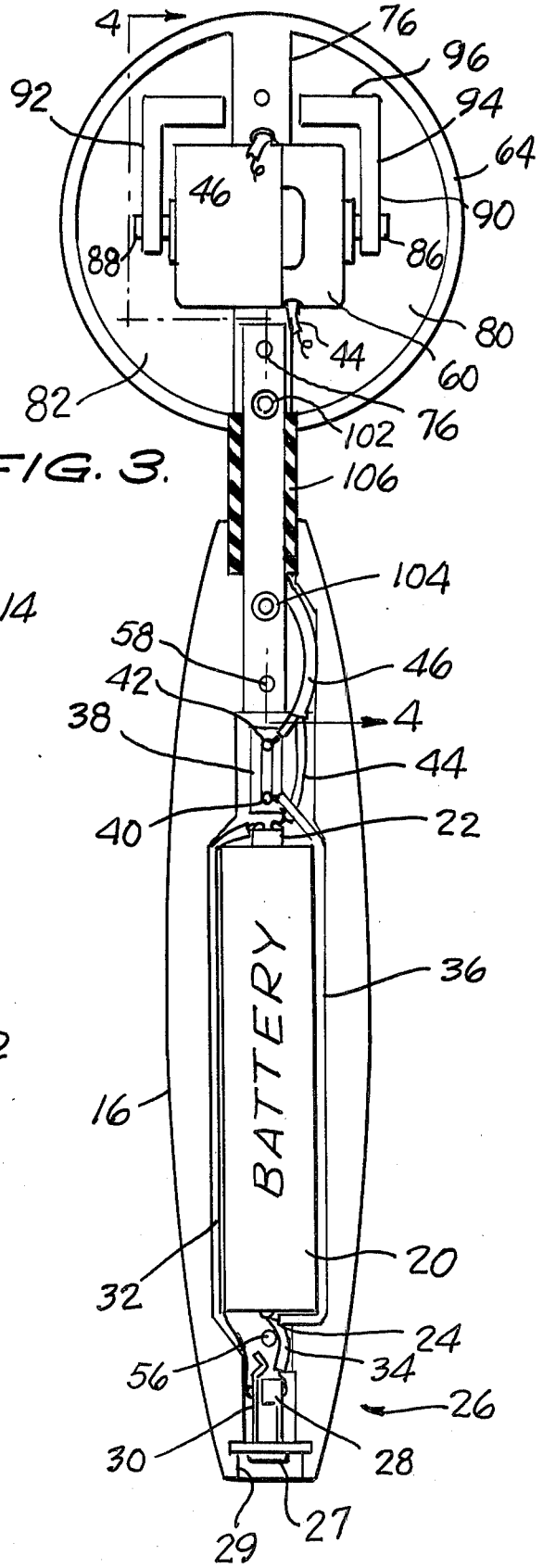
FIG. 3 is a cross-sectional view of the preferred embodiment illustrated in FIG. 1 and taken along line 3—3 thereof.

Referring now to FIG. 3, the battery 20 is seen to include a positive terminal 22 and a negative terminal 24. Mounted adjacent the negative terminal 24 near the lower end of handle portion 12 is a female connector indicated generally by reference numeral 26 which has a plug receiving portion 27 centrally positioned in an open end 29 of the handle 12. The female connector 26 is adapted to receive a male terminal 52 of a battery recharging unit 54 which, as is well known, may be mounted in a standard wall receptacle in order to recharge the battery 20 as necessary.

The female connector 26 includes a negative terminal 28 which is connected to terminal 24 of battery 20 via a connecting wire 34, and a positive terminal 30 which is connected to the positive terminal 22 of battery 20 via a lead wire 32. A connecting wire 36 is also provided between the negative terminal 24 and the contact 40 of a thumb switch mounting plate 38. The mounting plate 38 supports a thumb switch 48 which extends through an opening 45 formed in the handle portion 12. A pair of mounting screws 50 extend through suitable apertures formed above and below the mounting hole 45 to secure the mounting plate 38 is position. The mounting plate 38 also includes an ON contact 42 which is connected to the OFF contact 40 when the thumb switch 48 is in its "on" position. This serves to electrically connect wire 36 to terminal 42 and wire 46. An additional electrical wire 44 is connected to the positive terminal 22 of battery 20, and wires 44 and 46 extend upwardly and outwardly from the casing 12 to supply electrical power to the vibrating motor 60, in a manner to be described in more detail hereinafter.

Also illustrated in FIG. 3 are a pair of threaded taps 56 and 58 which are adapted to receive a pair of mounting screws, such as screw 62 (FIG. 4) to hold the handle covers 16 and 18 together.

The vibrating portion 14 of the massager 10 comprises a pair of semi-spherical housings 64 and 66 which may be held together, for example, by a pair of wood screws 68 and 70 which are preferably recessed from the surface of housings 64 and 66 by means of bores 72 and 74 formed in housing 64 (see FIG. 4).

As seen in FIGS. 3 and 4, each of the semi-spherical housings 64 and 66 includes a semi-annulus or half ring 76 and 78 which extend vertically along the mid-portion of the respective housings.

As seen more particularly in FIG. 3, the semi-annulus 76 forms a pair of recesses 80 and 82 on either side thereof within housing 64 which are congruent to and mate with a similar pair of recesses in housing 66. Further, semi-annulus 76 includes an inner, semi-circular surface 84 (FIG. 4) which, together with the semi-circular surface 85 of housing 66, forms a doughnut-like mount for the substantially cylindrical housing of electric motor 60.

The mounting members 76 and 78 encircle or encompass only the central portion of motor housing 60 such that each end 86 and 88 of the shaft of the motor extends into the recesses 80 and 82 of the housings.

Mounted on each end 86 and 88 of the motor shaft are a pair of eccentric weights 90 and 92 which are substantially identical with one another. The weight 90, for example, includes a substantially flat, triangular side portion 94 whose apex 95 contains an aperture for receiving the end 86 of the motor shaft, which are suitably secured together. The weight 90 also includes an arcuate top portion 96 which is curved in a substantially congruent shape to that of the outer cylindrical surface of motor 60 and extends towards the central support block 76 in the manner illustrated in FIG. 3.

The weight 92 is substantially identical to the weight 90 just described, but is mounted upon the opposite end 88 of the motor shaft in such a fashion that weights 90 and 92 rotate in unison about the motor 60 within the recesses 80 and 82 so as to impart a vibratory motion to spherical portion 14.

Interconnecting the handle portion 12 with the spherical vibrating portion 14 is a flat, steel spring 100 which is secured to handle portion 12 by means of a screw 104 and to vibrating portion 14 by means of screw 102. The electrical wires 44 and 46 pass adjacent spring 100 (not shown for the sake of clarity) between the switch plate 38 and the motor 60. Surrounding the wires as well as the flat spring 100 is preferably a sheath 106 which may be made of a resilient material such as rubber.

It should be noted that the plane of the flat spring 100 is parallel with the axis of the motor shaft defined by ends 86 and 88. This results in maximum transmission of the vibratory motion imparted by rotating weights 90 and 92 to the spring 100. The vibrating action of portion 14 may therefore be thought of as lying in a single plane as indicated by double-ended arrows 69 in FIG. 4. The large mass of the motor 60 and the design of weights 90 and 92 so as to be rotating about the motor 60 yield an extremely efficient coupling of the energy generated by the motor with extremely low losses as a result of the mounting of the motor 60 directly in the vibrating housing 14. It may be appreciated that the motor itself, being centrally disposed within the rotating weights, becomes a vibratory imparting mass so as to further enhance the operating characteristics of the massager.

FIGS. 5 and 6 illustrate an alternative embodiment of the present invention which includes a handle portion 110, a bifurcated neck portion 112, and a pair of substantially spherical massaging balls 114 and 116, each of which contains its own vibratory motor and weight assembly, as was in ball 14 of the first embodiment. The massaging balls 114 and 116 are connected to the bifurcated neck 112 by individual, preferably flat spring members 118 and 120 which are enclosed in a protective rubber sheath. The unit of FIGS. 5 and 6 may also include a rechargeable battery having a receptor 122 for the recharging unit, as in the first embodiment.

Referring now to FIG. 7, an alternative embodiment of the present invention is illustrated wherein a single shaft 130 includes a plurality of individual vibrating members 132, 134, 136, 138, 140, 142, 144, 146 and 148, each of which is connected to the shaft 130 via an individual spring 150. Each of the vibrating members 132, 134, 136, ... 148, contains its own electric motor and eccentric weight assembly, as typified by the structure within vibrating portion 14 of the embodiment illustrated in FIGS. 3 and 4. The embodiment of FIG. 7 may, however, require an external source of power for which power cord 160 may be conveniently provided.

Obviously, numerous modifications and variations of the present invention are possible in light of the above teachings. It is therefore to be understood that within the scope of the appended claims, the invention may be practiced otherwise than as specifically described herein.

I claim as my invention:

1. A massager, which comprises:

a handle portion;

a vibrating portion;

resilient means interconnecting said handle portion with said vibrating portion; and electric motor means mounted within said vibrating portion and including a substantially cylindrical housing, an axial shaft concentrically mounted in said motor housing and having one end portion extending beyond one end wall of said housing, and eccentric weight means mounted to said one end portion of said shaft;

said eccentric weight means including a first weight which comprises a substantially flat, triangular shaped base positioned adjacent said end wall of said housing and whose apex is connected to said one end portion of said shaft, and a body portion disposed adjacent the cylindrical outer surface of said motor housing and which extends integrally and transversely from said base so as to rotate therewith about said motor.

2. The massager as set forth in claim 1, wherein said vibrating portion comprises a substantially hollow housing having means for mounting said electric motor therein.

3. The massager as set forth in claim 2 wherein said hollow housing is substantially spherical and includes a ring-shaped annulus centrally positioned therein within which said electric motor is mounted.

4. The massager as set forth in claim 3 wherein said handle portion is elongated and includes means for selectively supplying electrical power to said electrical motor.

5. The massager as set forth in claim 4, wherein said electrical power supplying means comprises a rechargeable battery positioned within said handle portion and including a connector means for selectively receiving battery recharging apparatus.

6. The massager as set forth in claim 1, wherein said shaft includes a second end portion which extends beyond the other end wall of said cylindrical housing.

7. The massager as set forth in claim 6, further comprising a second weight substantially identical to said first weight and connected to said second end portion of said shaft.

8. A massager, which comprises:

an elongated handle portion having electrical power supply means therein;

a vibrating portion including a substantially hollow spherical housing;

resilient means interconnecting said handle portion with said vibrating portion; and electric motor means mounted within said housing and including a shaft and weight means eccentrically mounted on said shaft, said motor means connected to receive electrical power from said power supply means to rotate said shaft;

wherein said resilient means comprises a substantially flat elongated spring, the plane of which is positioned parallel to the axis of said motor shaft.

9. The massager as set forth in claim 8, further comprising a rubber or like sheath which encases said flat spring.

10. A massager, which comprises:

a handle portion;

a vibrating portion;

resilient means interconnecting said handle portion with said vibrating portion;

electric motor means mounted within said vibrating portion; and a second vibrating portion containing a second electric motor means and connected to said handle portion via second resilient means.

11. A massager, which comprises:

a handle portion;

a vibrating portion;

resilient means interconnecting said handle portion with said vibrating portion;

electric motor means mounted within said vibrating portion; and a plurality of vibrating portions each containing its own electric motor and connected to said handle portion via a plurality of respective resilient means.

12. The massager as set forth in claim 1, wherein said body portion of said weight includes an arcuate inner surface spaced adjacent and concentrically with respect to said cylindrical outer surface of said motor housing.

* * * * *